United States Patent [19]

Mittal et al.

[11] Patent Number: 4,460,350

[45] Date of Patent: Jul. 17, 1984

[54] CONTINUOUS PRINTED PAPER STACKING DEVICE

[75] Inventors: Faquir C. Mittal, Audubon; Joseph M. Curley, Lansdale, both of Pa.

[73] Assignee: Sperry Corporation, New York, N.Y.

[21] Appl. No.: 440,196

[22] Filed: Nov. 8, 1982

Related U.S. Application Data

[63] Continuation of Ser. No. 183,599, Sep. 2, 1980, abandoned.

[51] Int. Cl.[3] ..... B65H 45/00

[52] U.S. Cl. ..... 493/412; 493/450

[58] Field of Search ..... 493/409–414, 493/418, 423, 450

[56] References Cited

U.S. PATENT DOCUMENTS 2,016,539 10/1935 Brenn ..... 493/410
3,735,975 5/1973 Sukel ..... 493/418 X
3,953,019 4/1976 Burke ..... 493/418
4,054,283 10/1977 Rayfield ..... 493/412 X

FOREIGN PATENT DOCUMENTS 1214983 4/1966 Fed. Rep. of Germany ..... 493/411

*Primary Examiner*—A. J. Heinz
*Attorney, Agent, or Firm*—James R. Bell; Thomas J. Scott; Marshall M. Truex

[57] ABSTRACT

Apparatus is disclosed for positioning a continuous paper form having uniformly positioned seams and emanating from a high speed printing device, such as from a high-speed computer printer, in a bin or stacker. Air jets positioned on the stacker are utilized in a mode whereby air bursts from the jets impinge at discrete locations on a top surface of the form as it emanates from the printer. The air bursts cause the continuous paper form to fold naturally in a stacker bin at the paper seams.

3 Claims, 7 Drawing Figures

CONTINUOUS PRINTED PAPER STACKING DEVICE

This is a continuation of application Ser. No. 183,599 filed Sept. 2, 1980 now abandoned.

BACKGROUND OF THE INVENTION

1. Field of the Invention

The present invention relates to a field of fluidics and particularly the use of fluidic pressure to control paper stacking of a continuous paper form.

2. Description of the Prior Art

A known prior art stacker used with high-speed computer printers which print on the order of 2,000 lines per minute utilizes spinning beaters or flappers to assist in folding a continuous paper form at its seams. The spinning beaters are placed on a rotating axle and comprise deformable plastic extensions that extend from a hub permanently positioned on the rotating axle. The flappers are located on a tray on which the continuous paper form is received after printing, such that they are in juxtaposition to the seams as they are about to fold. In effect, the flappers beat on the seams as they are about to fall in place on the tray and, accordingly, assists in the re-folding process.

A shortcoming of the above-discussed known prior art technique is that as the line printing speed increases to modern-day speeds of 10,000 lines per minute (i.e., 50 inches per second), the prior art beaters do not perform their function in a satisfactory manner and stacking often occurs in an improper manner, thereby throwing the continuous paper form into disarray. The present invention obviates the above-mentioned shortcomings of the prior art.

BRIEF SUMMARY OF THE INVENTION

The present invention provides fluidic jets of air which are located on either side of a paper stacker to fold at a seam located at uniform distances along the form. As understood, printing takes places between two continuous seams (hereinafter called a sheet).

In today's high-speed printing operations such as used by high-speed laser printers in the computer industry, wherein printing speeds of 20,000 lines per minute (50 inches/second) and slewing (line skipping) rates of 90 inches per second are not uncommon, it is difficult to avoid paper jams because the paper will not always fold at the seam. This type of difficulty will require an operator to shut the printer off until the paper with its valuable printing can be corrected. If an operator is not immediately at hand, the above problem can become monumental. Difficulty may also be encountered in the above-mentioned high-speed printers because the paper form will be placed in a slew mode by the computer so that numerous lines will be skipped such that the paper form will move even faster than when in its normal print mode.

The fluidic air jets in the present invention release bursts of air at discrete times and locations on an upper surface of the paper, thereby producing a force on each sheet of the continuous form so that it will locate itself correctly in the stacker. Consequently, each consecutive sheet will be made to rest on a previous sheet and the process continues as long as the paper is moving in the stacker.

DESCRIPTION OF THE PREFERRED EMBODIMENT

Figure 1:
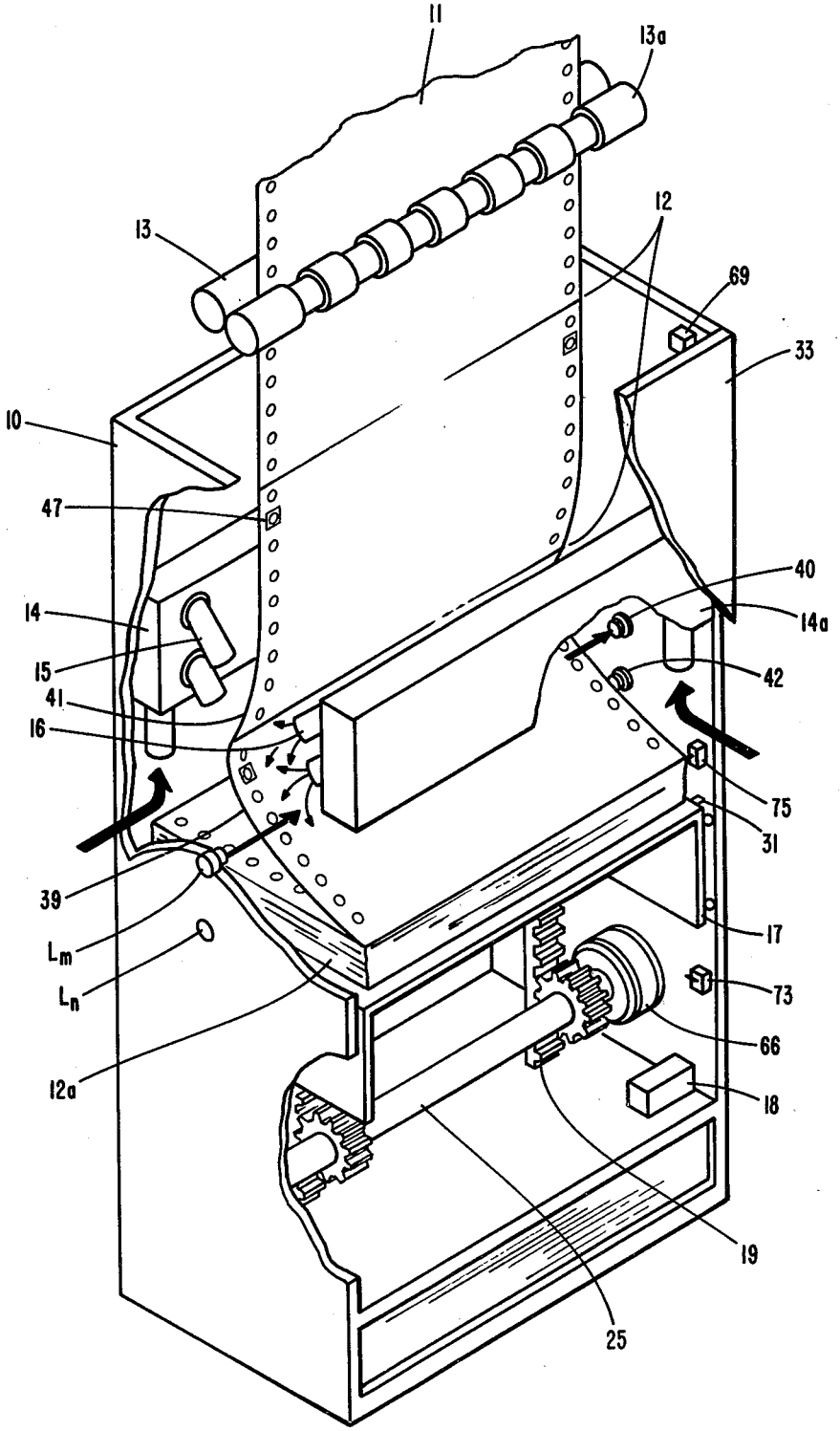
FIG. 1 is a three-dimensional view of the high speed paper stacker of this invention.

Referring now to FIG. 1 in greater detail, the paper stacker 10 of this invention is depicted and, in a preferred embodiment, is utilized in association with a high speed printer (not shown) which may be, for example, employed with a computer device. A paper form 11, which has alphanumeric characters formed thereon, is made to pass between the rollers 13, 13*a* so as to exert a slight amount of tension thereon as it emanates from the printer. The continuous paper form 11 is designed with a pre-fold or seam 12 which is positioned across a width dimension, and in a preferred embodiment, every 11 inches of its length dimension.

As the paper form 11 emanates from the printer (not shown), it tends to fold because of the seams 12 in a stack 12*a* on a tray or platform 17. In the known prior art, as the paper stack 12*a* increases in weight, the tray 17 automatically lowers itself. In the instant invention, however, a rack 19 and pinion 25 device is provided in order to move the tray 17 in an up/down mode under control of a stepper motor 66. The motor 66 is energized by a control circuit which includes paper height detectors comprising light emitting diodes (hereinafter LED) Ln, Lm and photo optical detectors 40, 42. As will become apparent in later paragraphs, the LED's Ln, Lm, in conjunction with the optical detectors 40, 42, will move tray 17 downwardly when light from the LED's is blocked by the paper stack 12*a*. The tray 17 will be moved downwardly a distance that will just enable light from LEDs Ln, Lm to be received by optical detectors 40, 42.

As was previously discussed, modern day high speed printers which utilize slewing speeds up to 90 inches/-second will not always fold properly at seams 12, for example, because of the rapidity of movement so that stacking malfunctions result. When an operator is not at hand, the results of such a stacking malfunction can be catastrophic.

The present invention utilizes positive pressure air when emanates from rows of jets 15, 16 (only four of which are shown) in an alternating fashion so that each consecutive sheet (e.g., sheet 39) will fold properly on tray 17. In the embodiment shown, air plenums 14, 14*a* are utilized which are supplied with air from an appropriate source (not shown). The air jets 15, 16 project from the respective plenums 14, 14*a* at an appropriate angle so that the air which is emitted therefrom impinges upon a top surface of each sheet. Thus, as shown in FIG. 1, the air emitted from jets 16 strikes the top surface of sheet 39 so that the force produced by the air stream urges paper sheet 39 to fold naturally onto the stack 12*a*. At a proper time, the air stream from jets 16 are turned off and the opposing air jets 15 are activated so that an air stream can be generated to impinge on the top surface of paper sheet 41 so that the latter will naturally fall upon sheet 39. Therefore, it can be readily appreciated that by alternately causing jets 15, 16 to emit air bursts, each consecutive sheet will fold at the proper seam and will position itself properly on tray 17.

Various limit switches are provided throughout the stacker 10 in order to indicate certain positions of tray 17. Thus, when the tray 17 reaches its lowest position, it will activate bottom limit switch 73 with flag 31, which is located on the tray; and, similarly, when the tray 17 reaches its highest position, a top limit switch 75 will be activated by the flag. These limit switches prevent the tray 17 from exceeding established limits of travel.

A third limit switch 69 is shown positioned in juxtaposition to door 33 and is de-activated upon opening thereof. The limit switches 69, 73 and 75 will be discussed in greater detail when discussing operation of an electrical circuit which accompanies this invention. It should be noted that a device 18 for sensing which air jets 15, 16 was last energized is located within stacker 10, near the rack 19 and pinion 25.

Figure 2:
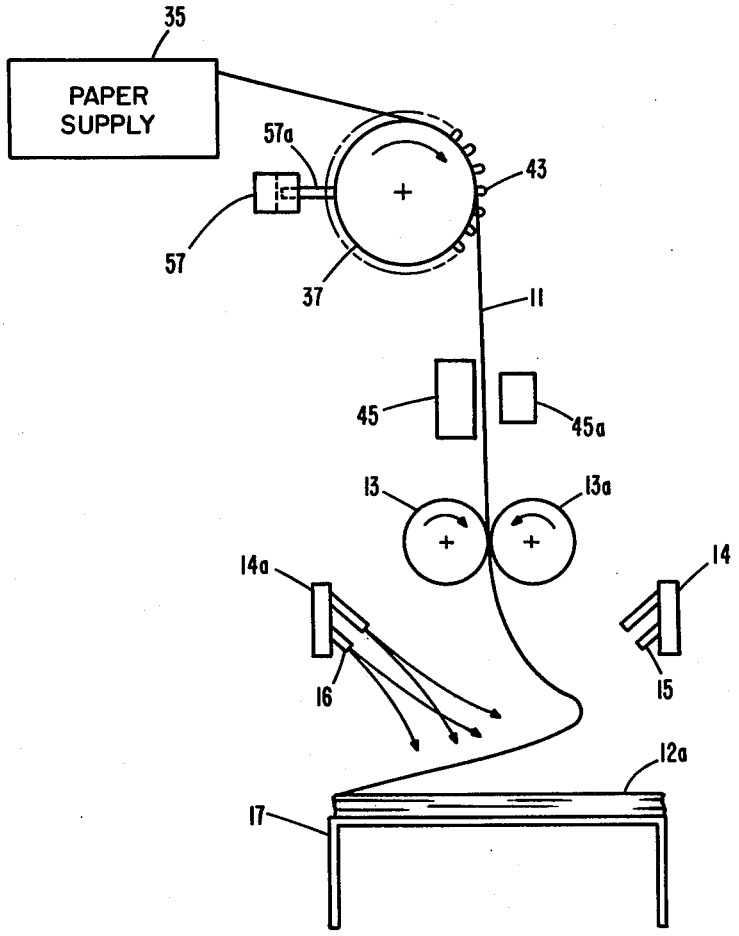
FIG. 2 is a schematic view of the invention in combination with a timing wheel.

Referring now to FIG. 2, the schematic illustrates how certain timing for the instant invention is obtained. Thus, when an operator is ready to thread paper 11 for printing at print station 45, which includes platen 45*a*, it is first withdrawn from paper supply 35 and then positioned upon a tractor timing wheel 37 such that a pre-formed square hole 47 (FIG. 1) is located on a unique tooth 43 thereof. The pre-formed square hold 47 is located near the seam 12. As is understood in the art, the timing tractor wheel 43, in conjunction with a second tractor wheel (not shown), in conjunction with the periodic holes located on each side of the paper pull the continuous form 11 out of the supply 35. By locating the pre-formed square hole on the special tooth 43 of the tractor wheel 43, the seams 12 of the continuous paper form 11 will always be located in a precise location with respect to print station 45, as well as air jets 15, 16. Therefore, the seam detector 22 comprising an LED (not shown) and a photo optical detector (not shown) will detect each revolution of the tractor or timing wheel 37 and each revolution of tractor 37 will comprise a seam 12 (FIG. 1) of paper form 11. In other words, since it is somewhat difficult to detect a seam itself, by retaining the paper 11 in a certain registration with respect to tooth 43 so that, in effect, a seam is near thereat, and the print station 45, platen 45*a*, as well as air jets 15, 16 can be properly oriented for printing purposes and for applying bursts of air to specific sheets 39, 41, for example. It is understood that the seam sensor signal may be utilized with respect to the print station 45 to initiate printing on the continuous paper form 11 between two consecutive seams 12.

Figure 3:
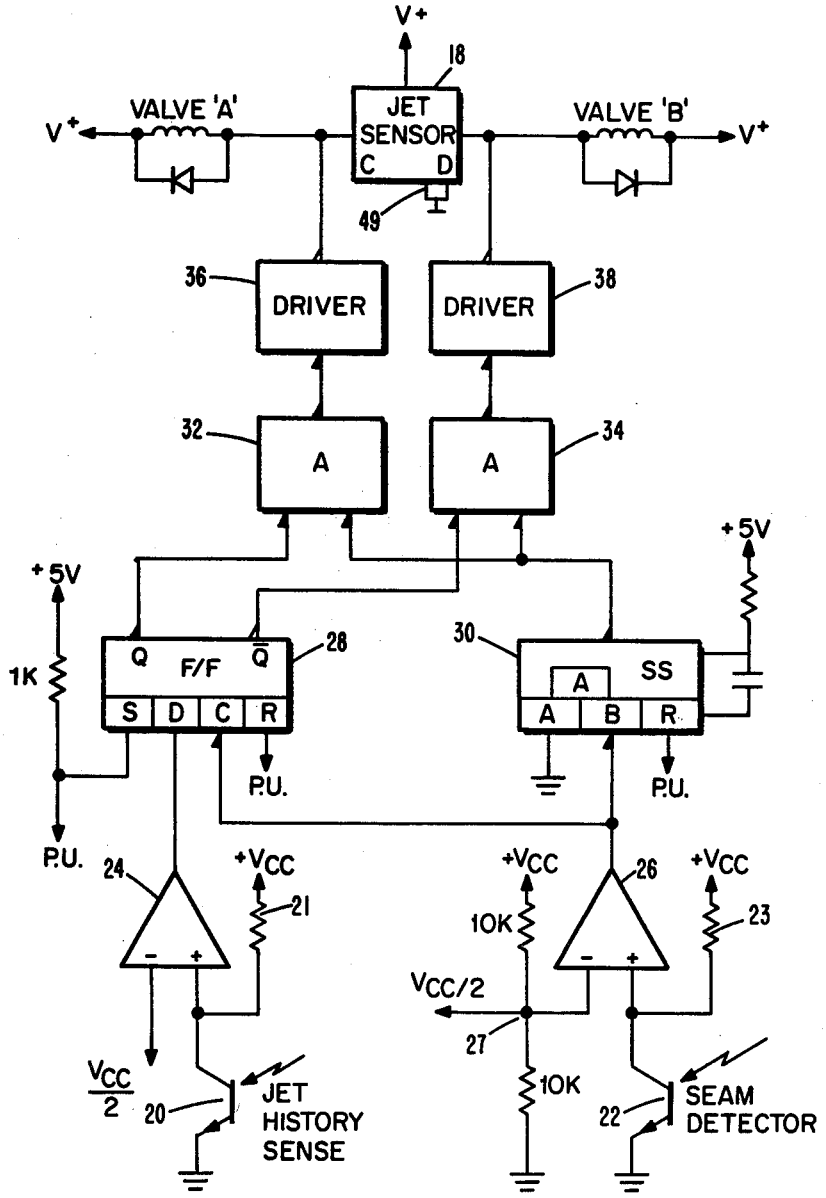
FIG. 3 is an electrical circuit used for energizing the air jets used with this invention.

Referring now to FIG. 3, there is depicted a logic circuit for providing properly timed signals for actuating coils A, B which are associated with respective air jets 15, 16 (FIG. 1). An electrical actuation of the coils of the valves A, B will cause a burst of air to be emitted from the rows of air jets 15, 16 in order to properly stack the continuous paper form 11 in the tray. It should be noted hereat that on FIG. 3, certain input/output flags, which are applied to various logic blocks, are black or white in color and represent a high (H) and low (L) voltage signal, respectively. A H voltage represents approximately 5 volts, whereas a L voltage indicates approximately zero or ground potential. The color of the input/output flags of the various shown logic blocks represent the voltages required to activate the circuit.

Figure 4:
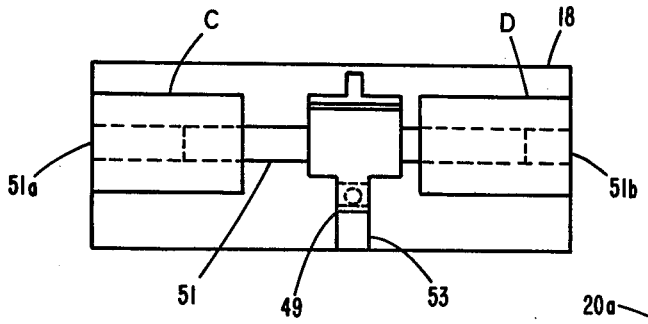
FIG. 4 is a schematic view of a device for determining the air jet history or the last air jet that was activated.
Figure 4A:
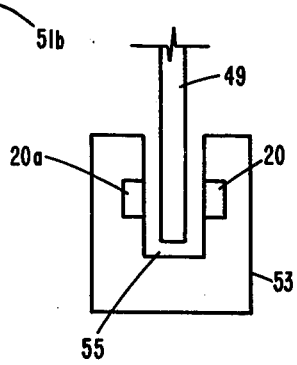
FIG. 4*a* is a schematic side view of the device of FIG. 4.

Solenoids C, D are integral units of a air jet state sensor 18 (hereinafter, jet sensor) as shown in schematic form in FIG. 4, 4*a*. As previously mentioned, the jet sensor 18 remembers which air jet coil A, B was last actuated. It will become obvious by later descriptions that it will be important to the operation of the logic circuit to know which valve was last energized. To accomplish this memory function reference is made to FIG. 4 wherein a plunger 51, which alternately is pulled into openings 51*a*, 51*b* when either coil C, D is respectively energized. The plunger 51 carries a flag member 49 which cooperates with U-shaped sensor 53. Flag 49 is arranged so that it blocks or allows light to pass from a LED 20A to a photo optical detector 20 carried by the U-shaped member 53, depending upon whether solenoid coil D, C is energized. The U-shaped member 53, shown in greater detail in FIG. 4*a*, depicts a slot 55 which allows the flag 49 to pass. As is understood, a beam of light will be emitted from the LED 20*a* which will be detected by the photo optical transistor 20. The flag 49 carried on the plunger 51 blocks the transmissions of light from the LED 20*a* when coil D is energized and the plunger 51 is totally within the coil opening 51*b*; on the other hand, the light from the LED 20*a* is transmitted to transistor 20 when the coil C is energized and the plunger 51 is totally within the opening 51*a*. Referring again to FIG. 3, the photo optical transistor 20, as well as the photo optical transistor 22, are semiconductor devices that are activated or conduct current when sufficient light impinges thereon. This light sensing capability is indicated by an arrow. Transistor 20 will be associated with jet sensor 18 (FIGS. 3, 4), whereas transistor 22 is associated with the seam detector 57. When activated by light, transistor 20, 22 conducts current from a supply voltage Vcc to ground via their respective collector-emitter electrodes, and their respective resistors 21, 23.

Figure 6:
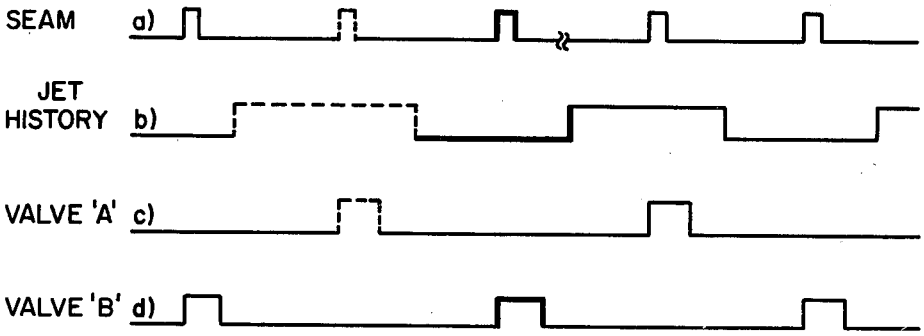
FIG. 6 is a timing diagram for showing the operating of this invention.

Referring again to FIG. 3 and its operation, let us assume that the jet sensor 18 (FIG. 4) indicates or remembers that jet valve B was the last to be energized after detection of a seam (see FIG. 6, lines a, b, c). In this assumed condition, the metal plunger is located completely within opening 51*b* (FIG. 4) so that the flag 49 blocks the light emanating from LED 20*a* across slot 55 (FIG. 4*a*). Since no light is received by photo optical transistor 20, its collector voltage which is applied via resistor 22 to a positive (+) terminal of voltage comparator 24 is H. A second input to the voltage comparators 24, 26 at its negative (−) terminal is a voltage Vcc/2, which is obtained from a voltage divider 27 and comprises a voltage +Vcc, two 10K resistors and ground. It can be readily seen that a node between the two 10K resistors is +Vcc/2. Output signals produced by the voltage comparators 24, 26 are either L or H depending upon the status of its input signals. As an example, when transistor 20 is non-conducting, the voltage +Vcc at the (+) input terminal of comparator 24 is more positive than its (−) input signal (+Vcc/2) and the output thereof is H. Conversely, when the (+) input of comparator 24 is L because transistor 20 is conducting, the (−) input signal is more positive than the (+) input signal and the comparator output voltage is L.

Since transistor 20 is non-conducting because valve B was the last to be energized, the H output voltage of comparator 24 is applied to the data line (D) of a D type flip-flop 28. The unused S and R terminals of flip-flop 28 are pulled up to a high level via a +5 volt power supply and 1K resistor. If this voltage were not applied to the R, S terminals the voltage thereat would tend to float and circuit operation of the flip-flop 28 would not be proper. The symbol PU indicates pull-up and signifies that the voltage at terminals S, R has been pulled-up from its floating value to a fixed value. It should be noted that the input signals applied to the S, R terminals of flip-flop 28 will otherwise have no effect on its operation.

The detection of a seam in the continuous paper form 11 is similar in operation to that described with respect to jet sensor 18 in that the seam detector 57 (FIG. 2) includes a LED light source (not shown) whose rays impinge upon a photo optical transistor 22 (FIG. 3). Accordingly, every time a seam is about to be detected, a flag 57*a* will block the light beam emanating from the LED source (not shown), causing the transistor 22 (FIG. 3) to stop conducting. Sensor 57 is functionally similar to sensor 53 (FIG. 4, 4*a*). Therefore, the voltage Vcc at positive (+) terminal of comparator 26 will be more positive than the voltage Vcc/2 at the (−) input. A positive going timing pulse will therefore be generated at an output terminal of comparator 26 and this timing signal is applied both to the clocking input of flip-flop 28 as well as a B terminal of a single-shot multivibrator 30. Input terminals A, R of the multivibrator are not used, so that each positive input signal at the input B causes a positive output signal of 50 millisecond duration to be produced after a seam is detected. The transistor 22 returns to its conducting state in order to await detection of a next seam as soon as the timing wheel 37 rotates in a further clockwise direction so that the seam detector 57 is no longer effective in blocking light from the above-mentioned LED (not shown).

The clocking of flip-flop 28 by the output of comparator 26 will hold the value present on the data input (in this case, an H signal) to set the flip-flop such that a H signal is present at output Q, whereas its $\overline{Q}$ output is a L signal. In other words, the H input or "1" on the data (i.e., D input) line is transferred to the Q output, the complement of "1" or "0" is transferred to the $\overline{Q}$ output as indicated by its L voltage. The H output signal emanating from output terminal Q is applied to a positive AND gate 32 and the L output signal from the $\overline{Q}$ output terminal is applied to AND gate 34 and, therefore, causes this latter gate to become blocked. The H output signal from the multivibrator 30 is applied to AND gate 32 which causes the latter to become conditioned and to thereby produce a H output signal. The H output signal from AND gate 24 is applied to driver 36 in order to enable this device. The enablement of driver 36 allows an electrical circuit to be completed from a V+ voltage via coil A to the driver circuit 36. The current through coil A activates the air jet 16 (FIGS. 1, 2) associated therewith for a period of 50 milliseconds, in order to generate a burst of air that impinges upon a top surface of sheet 39 (FIG. 1) of the continuous paper form 11. The burst of air will cause the sheet 39 to properly position itself in the tray 17.

The above-described operation will cause the air jet sensor 18 (FIGS. 3, 4, 4*a*) to operate so that plunger 51 is pulled completely into the opening 51*a*, and therefore the flag 49 is made to clear the slot 55 (FIG. 4*a*) such that light from LED 20*a* is transmitted to the photo optical transistor 20. In other words, the flag 49 of FIG. 4 is switched to the C side which associated the A solenoid valve. Solenoid coil C of the jet sensor 18 is energized to allow plunger 51 to move within opening 51*a* by completing a circuit between V+ and driver 36. The generation of the seam, the jet history and valve 'A' signals are shown in dotted form in FIG. 6, lines a, b and c, wherein the jet history signal is the output state of amplifier 24.

After a period of 50 milliseconds, the output of the single-shot multivibrator 30 returns to its quiescent state and therefore its output returns to a L voltage state. Accordingly, the AND gate 32 becomes inactive which, in turn, blocks driver 36. The solenoid coil A is no longer energized and the air jet 16 is shut off. It should be understood that whether the paper form 11 is traveling 50 inches/second or 90 inches/second, the 50 millisecond air burst from jet 16 will supply sufficient force against sheet 39.

As soon as the flag 49 no longer blocks light emitting from the LED 20*a* (FIG. 4*a*) because of the activation of coil A, transistor 20 conducts so that the voltage (Vcc/2) at the (−) input of comparator 24 is more positive than that at the (+) input, which is near ground potential. Therefore, its output will be L as applied to the data (D) input of flip-flop 28. Similarly, the next timing pulse from the seam detector 57 (FIG. 2) will block transistor 22 so that it stops conducting and the (−) input voltage (Vcc/2) of comparator 26 is less positive than the voltage at the (+) input terminal which is at a potential Vcc. Therefore, the positive output of comparator 26 provides a signal for clocking in the signal on the data line D of flip-flop 28 as well as to activate the single-shot multivibrator 30 by activating its B input terminal. However, it should be recalled that when coil A (FIGS. 3, 4) was energized, the flag 49 no longer blocked the LED 20*a* from transmitting light to the photo optical transistor 20 and the latter began conducting current through its collector-emitter junctions. The (+) input of comparator 24 will, therefore, be at approximately ground potential, whereas the (−) input will be at a potential of Vcc/2. Comparator 24 will now produce a L output signal and this signal on the data line D will be sampled by the pulse from comparator 26 to re-set flip-flop 28. The re-set flip-flop 28 will produce a L signal at its Q output, and a H signal at its $\overline{Q}$ output terminal. The L output applied to the AND gate 32 will block this device so that its output will be L.

On the other hand, the H output signal from multivibrator 30 in combination with the positive output from the $\overline{Q}$ output of flip-flop 28 will enable AND gate 34 which thereby produces a positive output. The positive output from AND gate 34 activates driver 38 to cause the coil B to be energized by allowing a current to be conducted from a supply voltage V+ to the driver circuit 38. The energizing of coil B causes a burst of air to emanate from air jet 15 which impinges upon sheet 41. It should be understood, of course, that the force produced by air jet 15 occurs after sheet 39 is nearly in a flat position. Also solenoid coil B of jet sensor 18 will be energized by completing the circuit between V+ and driver 38. The generation of the seam, jet history and valve "B" signals are depicted in FIG. 6 with emphasis on lines a, b and d.

It can, therefore, be readily appreciated that coils A, B will be alternately energized for 50-millisecond periods to enable air jets 15, 16 to alternately produce bursts of air, which will impinge on the top surface of the individual sheets comprising the continuous paper form 11. It can also be appreciated that the jet history device 18 (FIGS. 4, 4*a*) assures that proper air jet will be activated.

Figure 5:
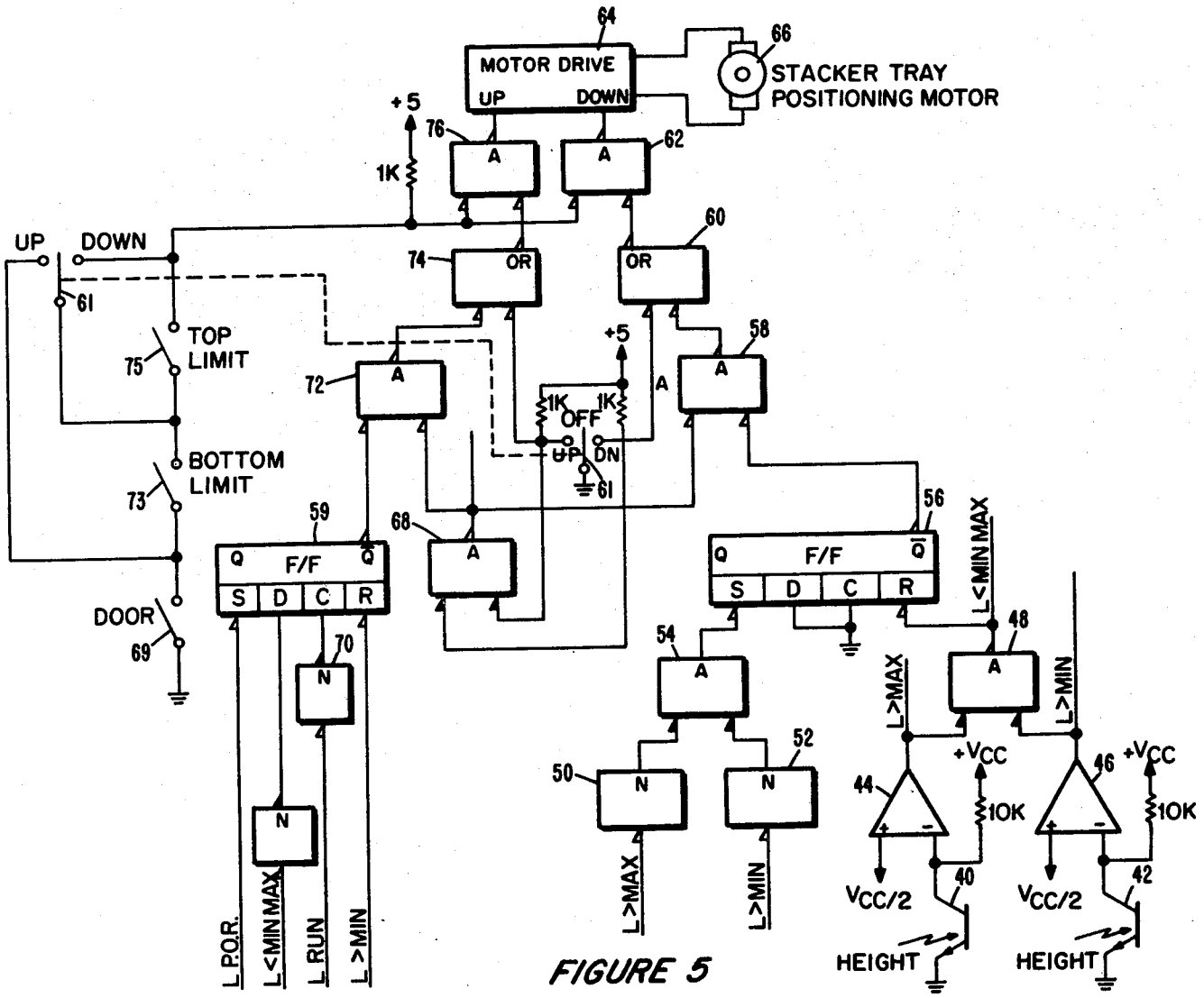
FIG. 5 is an electrical circuit for automatically repositioning the tray after a paper stack thereon has reached a certain height.

Referring now to FIG. 5, there is depicted a logic circuit for maintaining the height of a paper stack in the tray 17 a nominal distance with respect to the sensors Ln, Lm, 40, 42 (FIG. 1). A stack height relationship or a distance between the top of the paper stack 12*a* and the sensors Ln, Lm, 40, 42 is maintained in order to locate the air jets 15, 16 a fixed distance from the stack top, so that the air bursts emanating from the jets may be effective in positioning the various sheets of the continuous paper form 11 in tray 17.

As the continuous paper form 11 feeds stack 12*a* on tray 17, the present invention will lower the tray automatically when the stack reaches a certain height. The reason for this automatic heights positioner is to maintain the top of stack 12*a* within a certain distance of the air jets 15, 16 so that they can function effectively on individual sheets of the paper form 11. The tray 17 is moved by means of a rack 19 and pinion 25 arrangement which is activated by a stepper motor 16.

The paper tray 17 moves in relation to the two sensors (FIG. 1) comprising the LEDs Ln, Lm and the photo optical transistor detectors 40, 42. The LEDs Ln, Lm and the detectors 40, 42 are respectively positioned on opposite sides of the stacker 10 in order to locate the top of the paper stack. For reference purposes, LED Ln and its associated optical transistor 42 are positioned for detecting a minimum height of the paper stack in the tray 17, whereas LED Lm and its associated photo optical transistor 40 are positioned for detecting the maximum height of the paper stack in the tray.

In order to understand the operation of the circuit (FIG. 5), which controls the operation of stepper motor 66, let us assume an operational mode wherein the tray 17 is stationary and motor 66 is inactive. Under these conditions, the flip-flops 56, 59 are in a re-set condition and photo transistors 40, 42 are both conducting. When transistors 40, 42 are both conducting, they are both receiving light from LEDs Lm, Ln and the paper stack 12*a* is not high enough to block light rays being transferred across the stacker 10 (FIG. 1). Let it be further assumed that after a certain time period stacking of the continuous paper form 11 takes place until it eventually blocks the light from the LEDs Lm, Ln. By blocking the light from the LEDs Lm, Ln, transistors 40, 42 no longer conduct from supply voltage +Vcc to ground via a respective 10K resistor and a collector-emitter junction. Therefore, the respective voltages at the collector junctions rise to approximately the voltage +Vcc so that (−) input terminals of voltage comparator 44, 46 become more positive than its (+) terminals, which are at +Vcc/2. Accordingly, the output signals of the voltage comarators 44, 46 are L and AND gate 48 is blocked. Therefore, the output of AND gate 48 is H, which is applied to a reset terminal of flip-flop 56 and has no effect thereon. The output signals of amplifiers 44, 46 are designated as L>max, L>min to indicate that these signals are L when the paper stack 12*a* (FIG. 1) is higher than the maximum and minimum positions as indicated by blocking of light rays from the LEDs Lm, Ln by the height of the stacked paper 12*a*.

When the L>max and V>min signals are applied to respective inverters 50, 52, they emanate therefrom as H signals. The H signals from inverters 50, 52 are applied to AND gate 54, whereby it becomes enabled. The L output of AND gate 54 is applied to flip-flop 56 so that it is placed in a SET state. It will be recalled that a H signal is applied to the R input of flip-flop 56 at this time because the AND gate 48 is not enabled. The H signal applied to the R terminal has no effect on flip-flop 56. Furthermore, the data (D) and clock (C) input terminals are placed at ground potential. Therefore, by this connecting arrangement of the flip-flop 56 only the S, R terminals will affect the operation thereof and in view of the particular signals applied to the S, R terminals as above, it will become set.

The setting of flip-flop 56 causes its $\overline{Q}$ output terminal to revert to a L voltage state, which is applied as one of two inputs to AND gate 58. The second input to the AND gate 58 is a L RUN signal which is produced from an output of an enabled AND gate 68. The L RUN signal is a L voltage signal that is produced as long as a manual switch 61 for running the tray 17 in an upward or downward direction is in a neutral position. The manual switch 61 is a double pole, double throw (DPDT) switch, as indicated by a dotted line. Thus, when the manual switch 61 is in a neutral position, a H voltage from +5 volt supply will be applied to respective input terminals of AND gate 68 via 1K resistors, thereby enabling the AND gate 68 and allowing a L signal to be applied to the second input of AND gate 58. The L RUN signal is also applied to an input of AND gate 72, but it will have no effect thereon in view of the non-setting of flip-flop 59. The L output of the enabled AND gate 58 is applied to OR gate 60 to enable the latter gate to also produce a L output signal which is applied to AND gate 62. The second L input voltage applied to AND gate 62 is applied from ground potential via the closed switches 69, 73, 75. The switches 73, 75 are normally closed and may be opened only under the following conditions: the top limit switch 75 is opened by movement of the tray 17 all the way to the top; switch 73 is opened by movement of the tray all the way to the bottom indicating that the tray is full; switch 69, which is normally open and is held closed by a door, is opened by the same door 33 to the stacker 10. Assuming that none of the conditions exist for opening the switches 69, 73 and 75, the AND gate 62 will be enabled so that it will produce a H active output voltage which, in turn will be applied to the DOWN terminal of motor drive 64 which in turn activates motor 66 so that tray 17 will be lowered.

Accordingly, the tray 17 will be driven in a downward direction until flip-flop 56 is re-set. This condition occurs as soon as the tray is driven sufficiently downward so that the light being emitted from LEDs Lm, Ln (FIG. 1) is no longer blocked by paper in the stack 12*a*. When both LEDs Lm, Ln are unblocked, the respective transistors 40, 42 begin conducting again so that current flows from the supply voltage +Vcc to ground via their respective collector emitter junctions and via their respective 10K resistors. In view of the conduction of transistors 40, 42 the voltage at the (−) terminals of comparators 44, 46 is near ground potential, and the voltage at the (+) terminals is Vcc/2. Since the voltage at the (+) terminal is more positive than that at the (−) input terminal, the outputs of the voltage comparators 44, 46 are H. The H output signals of voltage comparators 44, 46 is applied to AND gate 48 to enable this gate and thereby produce a low output level which is in turn applied to the re-set (R) input of flip-flop 56. The re-setting of flip-flop 56 causes the Q output to revert to a H voltage state which is directed to one of the two input terminals of AND gate 58. This action blocks AND gate 58, whereby a H signal is applied to the DOWN terminal of motor drive 64 to shut off the motor 66 via OR gate 60 and AND gate 62. When motor 66 is disengaged, the top of the paper stack in the tray is again at a nominal distance below LEDs Lm, Ln.

The tray 17 may also be operated in a manual mode for upward and downward motion by means of the DPDT switch 61. When the switch 61 is moved leftwardly to contact the UP contact, current is conducted from a positive +5 volt supply to ground via a 1K resistor, the UP contact and the switch. Therefore, as long as one of the two inputs to the OR gate 74 is a L signal, the OR gate 74 produces a L output signal which is applied as one of the two inputs to AND gate 76. The second input to AND gate 76 is also a L voltage signal because switches 69, 73 and 75 are all closed so that a current can flow from the voltage supply +5 volts to ground via the 1K resistor, and the closed switches 69, 73 and 75. Therefore, the AND gate 76 is enabled by the two L input signals so that it produces a L output signal which is applied to the UP terminal of the motor drive 64. The L signal applied to the UP terminal of motor drive 64 activates the motor 66 to rotate in a direction to move the tray 17 in an upward direction until switch 61 is returned to the neutral position or top limit switch 75 or door switch 69 opens. It should be noted hereat that a second input to OR gate 74 was a H value because AND gate 72 was not enabled at this time. This was a result of the fact that upon moving switch 61 to the UP contact, the AND gate 68 was blocked since one of the two inputs thereto is near ground potential. The output of AND gate 68 is now at a H voltage value whereby the AND gate 72 is blocked. The output of the disabled AND gate 72 is, therefore, a H voltage value.

Similarly, when the tray 17 is to move downwards by a manual movement of switch 61 to the DN contact, the OR gate 60 will be enabled by a L voltage signal caused by current conduction from the +5 voltage supply to ground via the 1K resistor and the DN contact.

The AND gate 62 will also be enabled by the L input signals from the enabled OR gate 60 output and the near ground signal originating from the current being conducted through the closed switches 69, 73 and 75. Therefore, the L output applied from the enabled AND gate 62 to the DOWN terminal of the motor drive 64 causes motor 66 to rotate and tray 17 to lower until an operator moves switch 61 to the neutral position or bottom limit switch 73 or door switch 69 opens.

Let us suppose that an operator manually drove the tray 17 in a downward direction on a certain day in order to unload the continuous paper form that has been printed upon and then power is removed from the device. When the operator returns the following day, the stacker tray 17 is too low and must be returned to a nominal position or just below the LED Ln, indicating a minimum height position. To accomplish this, the flip-flop 59 is activated to a set position by means of a L signal applied to its S input by means of a Power-On Reset Line (L P.O.R.) signal. The Power-On Reset signal will be activated by the operator applying power to the associated printer system. The L signal applied to the S terminal of flip-flop 59 is generated by a General Clear signal and is obtained when power to an associated printer system (not shown) is turned on. The L voltage signal will set flip-flop 59 and cause the $\overline{Q}$ output to produce a L output, which is applied as one of the two input signals to AND gate 72. The re-set (R) terminal of flip-flop 59 will have a H voltage applied thereto because the tray 17 is below the minimum LED Ln and the output of amplifier 46 (designated L>min) is H. In other words, the tray is <minimum and, therefore, the output of amplifier 46 is H in view of the conduction of transistor 42.

Returning now to the AND gate 72, its second input terminal is a L voltage state in view of the neutral position of switch 61. Since both input signals to AND gate 72 are L, the gate will be enabled and it will produce a L output signal to thereby enable OR gate 74. The L output of enabled OR gate 74 causes a L signal to be applied to one of the two input terminals of AND gate 76. The second input to AND gate 76 is also L when switches 69, 73 and 75 are closed to allow current conduction from the +5 voltage supply to ground. Therefore, the L input signals enable AND gate 76, which produces a L output. The UP terminal of the motor drive 64 will be activated to cause the motor 66 to be energized and cause the tray 17 to move upward (FIG. 1).

The tray 17 will continue to move upwardly until flip-flop 59 is reset. Resetting of flip-flop 59 occurs when the tray 17 is driven upwardly until it reaches the LED in which is located at the minimum height distance and blocks the light rays emanating therefrom. As soon as tray 17 reaches this position, transistor 42 stops conducting. When the blockage of light from LED Ln occurs, voltage at the (+) terminal (Vcc/2) of the comparator 46 is less positive than its (−) terminal which is near +Vcc. The output (L>min) of voltage comparator 46 is therefore a L signal which re-sets flip-flop 59. By re-setting flip-flop 59, AND gate 76 is blocked so that motor drive 64 no longer causes motor 66 to rotate and tray 17 stops.

Another assumed situation may occur in actual operation wherein the operator may push the tray 17 in a downward direction below the nominal position represented by the minimum position LED Ln (FIG. 1) for some reason, and then fail to return it to its nominal position near LED Ln. The logic circuit of FIG. 5 will automatically return tray 17 to its nominal position in such an assumed situation. When the tray 17 is below the minimum position as indicated by the LED Ln and its associated transistor light detector 42, the AND gate 48 is enabled and thereby it produces a L output signal (L<MIN MAX). The L output signal (L<MIN MAX) is inverted by inverter 77 and applied as a H signal to the D terminal of flip-flop 59. The signal (L RUN) for clocking in the signal on the D terminal of flip-flop 59 is obtained as soon as the switch 61 returns to the neutral (i.e., L) or Center-Off position after contacting the DN terminal. Upon switch 61 returning to the neutral state, AND gate 68 is enabled to thereby generate a L output signal (L RUN). The L RUN signal is applied to AND gate 72 and to inverter 70, which produces a H signal which is applied to the C input terminal of flip-flop 59 such that the H signal in the D terminal is clocked in to set flip-flop 59 and output $\overline{Q}$ becomes a L output signal. AND gate 72 is, therefore, enabled by its two L input signal to produce a L output signal which is applied to OR gate 74. OR gate 74 is therefore enabled to produce a L output signal which is applied to AND gate 76. The second input to AND gate 76 is also L because it is near ground potential due to conduction from the +5 volt supply to ground via closed switches 69, 73 and 75. Accordingly, the enablement of AND gate 76 causes a L output which is applied to the UP terminal of the motor drive 64. This signal causes the motor 66 to become energized and to cause tray 17 to move further upwardly.

As soon as the tray 17 reaches the minimum or nominal position as indicated by the LED Ln, the transistor optical detector 42 will stop conducting because the rays will be blocked by the paper stack 12*a* in the tray. Therefore, the output of comparator 46 will be L (i.e., the stack is greater than the minimum position) since the (−) input terminal at a voltage +Vcc is higher in value than the (+) terminal at a voltage Vcc/2. The L output of comparator 46 is applied to R terminal of flip-flop 59 to re-set the latter. The re-setting of flip-flop 59 causes the $\overline{Q}$ output to revert to a H state which will disenable AND gates 72, 76 and OR gate 74. It should be noted that the second input of OR gate 74 is H because the switch 61 is in the neutral position.

In view of the above-described operation, the motor 66 will stop conducting and the tray 17 will stop at a position that just blocks the rays emanating from LED Ln.

What is claimed is:

1. Apparatus for folding and stacking a continuous sheet of fold form paper which is provided with periodic seams comprising:

(a) means including air jets located on opposite sides of said fold form paper for emitting directional streams of air thereon;

(b) means for receiving said continuous sheet of paper after passing said air jets;

(c) means for detecting a position of said seams with respect to said air jets;

(d) means for activating said air jets for emitting opposed directional streams of air in response to a signal from said means for detecting a position of said seams, whereby synchronization with a passage of said seams opposite said air jets is effected to cause consecutive sheets to fold over one another for forming a uniform stack of paper on said receiver from said continuous sheet of paper; and (e) means for remembering a last actuated one of said air jets, said means including an air jet sensor having solenoids and a plunger selectively moved into one of a pair of opposed openings in said air jet sensor in response to an associated one of said solenoids being energized, said plunger having a flag member operable with a light sensor for blocking a light beam detector carried by said light sensor.

2. Apparatus in accordance with claim 1, further including:

(a) means coupled to said receiving means for adjusting same in accordance with height of said stack.

3. Apparatus in accordance with claim 2, wherein said means for adjusting comprises:

(a) first and second light detection means for detecting a minimum and maximum height of said paper stack with respect to said air jets.

* * * * *